United States Patent [19]

Dickhudt et al.

[11] Patent Number: 4,824,089

[45] **Date of Patent: * Apr. 25, 1989**

[54] RETRACTABLE BUTTOCKS SUPPORT FOR OPERATIONS IN THE PRONE SITTING POSITION

[75] Inventors: Eugene A. Dickhudt, New Brighton; Charles D. Ray, Wayzata, both of Minn.

[73] Assignee: Cedar Surgical, Inc., Minnetonka, Minn.

[ * ] Notice: The portion of the term of this patent subsequent to May 5, 2004 has been disclaimed.

[21] Appl. No.: 66,149

[22] Filed: Jun. 25, 1987

[51] Int. Cl.[4] ..... A61G 13/00

[52] U.S. Cl. ..... 269/328

[58] Field of Search ..... 269/322–328; 5/431, 437, 443, 444; 128/133, 134

[56] References Cited

U.S. PATENT DOCUMENTS

| | | | |
|---|---|---|---|
| 1,593,801 | 7/1926 | Koch | 5/437 |
| 3,505,994 | 4/1970 | Smith, Jr. | 5/443 |
| 3,643,938 | 2/1972 | Levasseur | 269/328 |
| 3,892,399 | 7/1975 | Cabansag | 269/328 |
| 4,407,277 | 10/1983 | Ellison | 128/134 |
| 4,662,619 | 5/1987 | Ray et al. | 269/328 |

*Primary Examiner*—Frederick R. Schmidt
*Assistant Examiner*—Judy J. Hartman
*Attorney, Agent, or Firm*—Moore & Hansen

[57] ABSTRACT

A known kneeling attachment to an operating table includes a platform on which a patient kneels with the torso positioned over one end of the operating table while the buttocks rest against a buttocks support including a rigid U-shaped yoke, the arms of which are connected to opposite sides of the operating table. In the buttocks support of the invention, the arms of the U-shaped yoke are connected to the inboard end of the platform, and a mast fixed to the crosspiece of the yoke is telescopically connected to the outboard end of the platform. This permits the yoke to be lowered to the level of the platform, thus allowing a patient to kneel on or dismount from the platform without first disconnecting the yoke. By making the platform of radiotransparent materials, x-ray beams can pass from a generator positioned beneath the platform, through the front of the patient's body, and to an image tube positioned above the patient's back.

15 Claims, 3 Drawing Sheets

RETRACTABLE BUTTOCKS SUPPORT FOR OPERATIONS IN THE PRONE SITTING POSITION

CROSS-REFERENCE TO COPENDING APPLICATION

The buttocks support of this invention is useful as a support for framework disclosed and claimed in an application entitled "Framework for Supporting Surgical Instruments at a Surgical Wound" (Ser. No. 066,147, filed June 25, 1987) and assigned to the company to which this invention is assigned. The disclosure of that application is incorporated here by reference.

BACKGROUND OF THE INVENTION

1. Field of the Invention

The invention concerns a buttocks support to be used in conjunction with a kneeling attachment that has a platform on which a patient kneels with the torso positioned over one end of an operating table while the buttocks rest against the buttocks support. The invention concerns improvements in both the buttocks support and the platform.

2. Description of Related Art

For back surgery, especially involving the lumbar spine, an operating table may be fitted with a kneeling attachment that permits a patient to assume the prone sitting position on a platform with the torso positioned over one end of the table while the buttocks rest against a buttocks support. The buttocks support may be provided by a rigid U-shaped yoke having a padded seat carried by the crosspiece of the yoke, the arms of yoke being telescopically locked to opposite sides of the operating table. See, example, U.S. Pat. No. 4,662,619 (Ray et al.); U.S. Pat. No. 4,391,438 (Heffington); and a brochure entitled "Andrews Spinal Surgery Frame" of Orthopedic Systems, Inc., Hayward, Calif.

The buttocks support shown in the drawing of the Ray et al. patent is completely independent from the platform. Its U-shaped yoke is telescopically fastened directly to the operting table after a patient kneels on the platform and the height of the platform has been adjusted relative to the bed of the operating table. After the operation, the yoke is removed to permit the patient to dismount or be lifted from the platform. When the platform is detached from the operating table, the yoke and platform are handled separately upon being stored or otherwise removed from the vicinity of the operating table.

In the buttocks support shown in the drawing of the Ray et al. patent, each of the thigh-support cushions is formed with an off-center longitudinal bore, and a slit permits the cushion to be slipped onto an arm of the U-shaped yoke. After the cushion has been rotated in place to provide the desired thigh support, straps are tightened around the cushion to cause it to remain tightly in place. Some attendants have found it awkward to tighten the straps sufficiently to ensure against slippage.

SUMMARY OF THE INVENTION

Like the buttocks support of the above-cited Ray et alo. patent, that of the invention is useful in conjunction with a kneeling attachment including a platofrm on which a patient kneels with the torso positioned over one end of an operating table. Also like that of the Ray et al. patent, the buttocks support of the invention includes a rigid U-shaped yoke having a crosspiece and two arms, and a rigid padded seatplate may be mounted on to the crosspiece. The buttocks support of the invention differs from that of the Ray et al. patent by having means for connecting the arms of the U-shaped yoke to the inboard end of the platform, a mast extending from the crosspiece, and means for telescopically connecting the mast to the outboard end of the platform to permit the yoke to be lowered to the level of the platform while the platform is connected to the operating table.

The novel buttocks support provides the following improvements over what is illustrated in the Ray et al. patent:

(1) The telescopic connections permit the U-shaped yoke to be retracted to the level of the platform, thus permitting a patient to kneel on or dismount from the platform without disconnecting the yoke.

(2) The buttocks support conveniently remains with the kneeling attachment when it is removed from the operating table, thus enhancing transport and storage.

(3) Because the buttocks support is mounted on the platform and thus only indirectly connected to the operating table, it can be in place during adjustment of the height of the platform relative to the bed of the operating table.

As in the Ray et al. patent, the buttocks support preferably includes thigh-supporting cushions, but the invention provides an improvement afforded by means for mounting the thigh-support cushions retractably on the yoke for laterally moving the cushions into contact means with the thighs of a kneeling patient. Preferred retractable mounting means include a pair of L-shaped rods, one arm of each rod being pivotably attached to the crosspiece of the yoke and the other adapted to receive a thigh-supporting cushion. As in the Ray et al. patent, the crosspiece may include a rigid seatplace for supporting a buttocks cushion, in which case the L-shaped rods can be pivotably attached in the seatplate.

The buttocks support of the invention can be used to mount framework for holding surgical instruments such as retractors at a surgical wound during back surgery. Preferred framework is disclosed in the copending patent application cross-referenced above. That framework includes a substantially rectangular rigid frame, the outboard end of which is releasably attached to the crosspiece of the U-shaped yoke while the inboard end is supported either from the arms of the yoke or from the inboard end of the kneeling platform.

The novel buttocks support preferably is used in conjunction with a kneeling attachment which has a platform made of radiotransparent materials. This permits x-ray beams to pass from a generator positioned beneath the platform, through the front of the patient's body, and to an image tube positioned above the patient's back. Since the lumbar spine may now be operated upon in the kneeling position, yet under full biplane x-ray visulization, guided surgical procedures on the lumbar spine may be performed that have previously been impossible.

THE DRAWING

The invention will be more easily understood in reference to the drawing, all figures of which are schematic, wherein.

Figure 1:
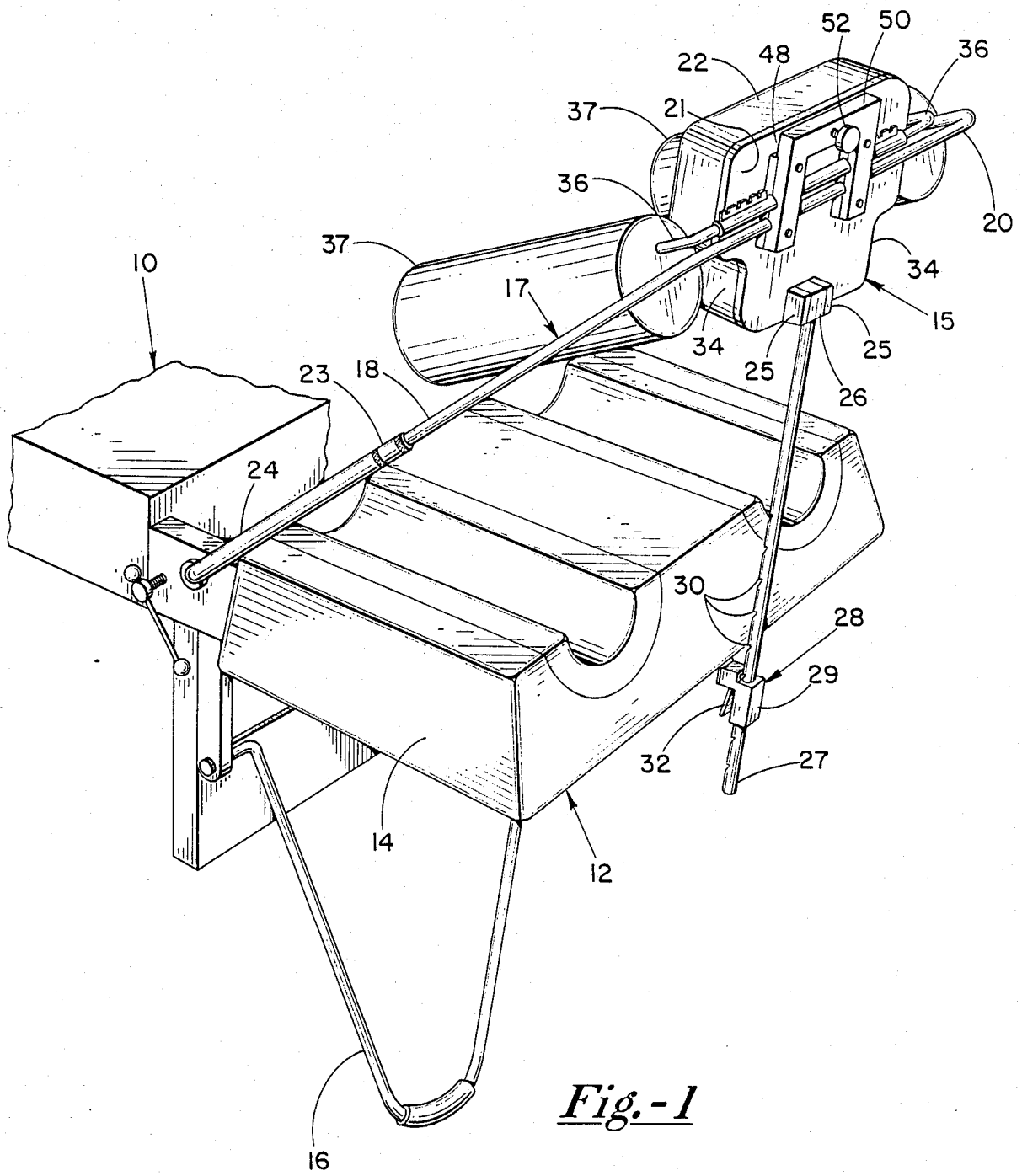
FIG. 1 is a perspective view of a buttocks support of the invention mounted on a kneeling attachment that is attached to an operating table, the buttocks support being in an operative position.
Figure 2:
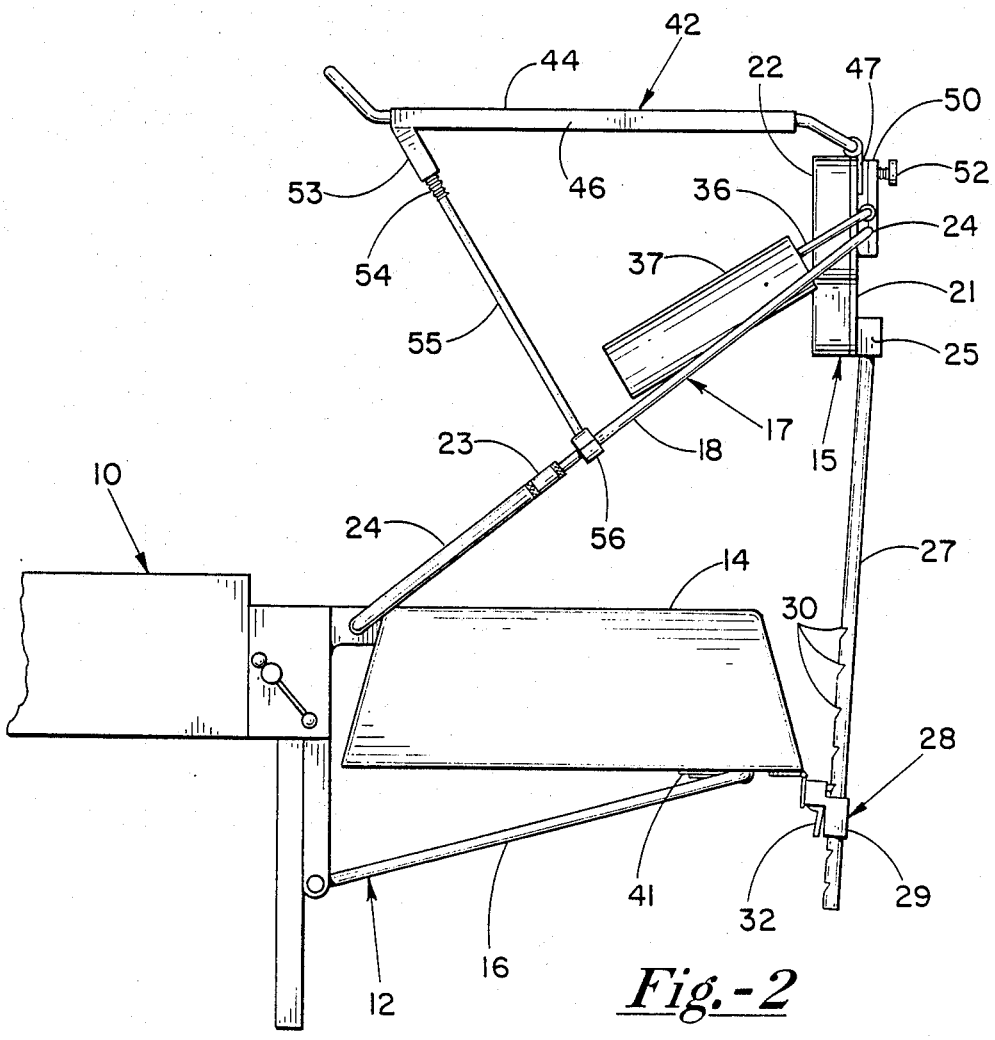
FIG. 2 is a plan view of the apparatus of FIG. 1 in the same operative position plus framework mounted on the buttocks support for holding instruments such as retractors at a surgical wound during back sugery.
Figure 3:
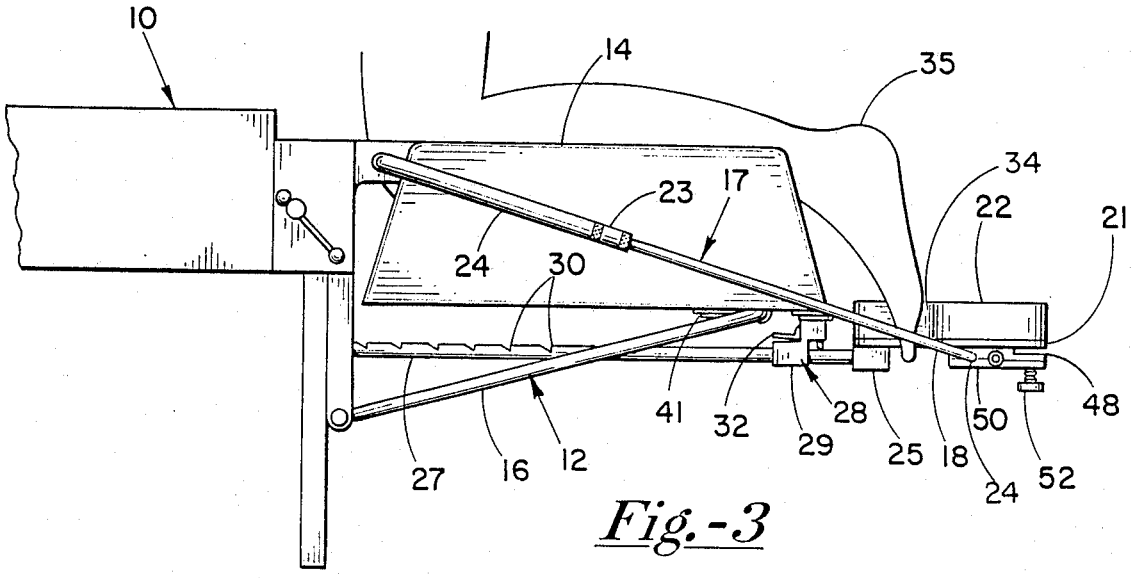
FIG. 3 is a plan view of the apparatus of FIG. 1 with the buttocks support retracted.
Figure 4:
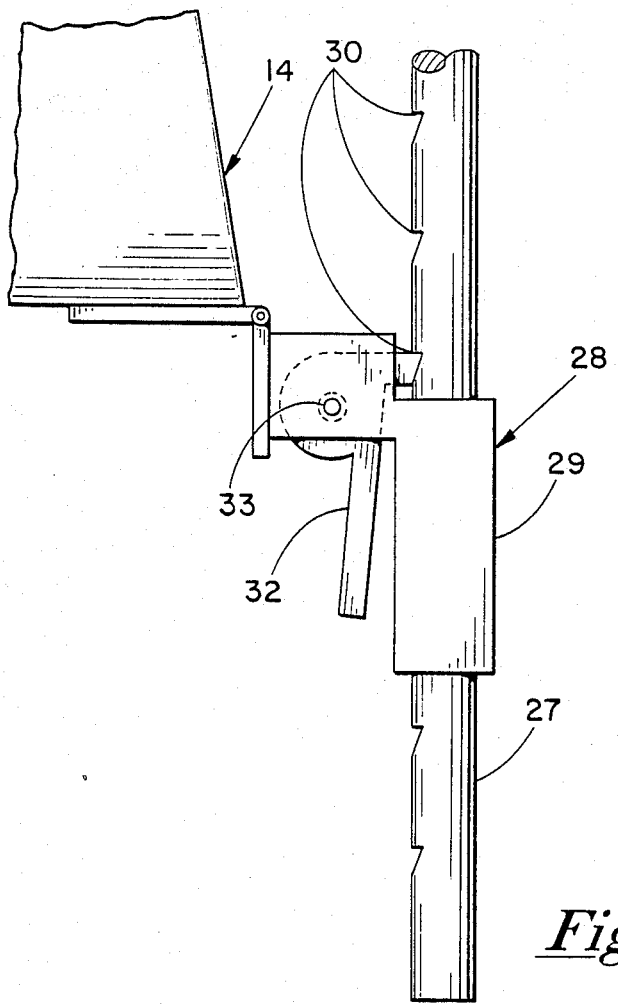
Figure 5:
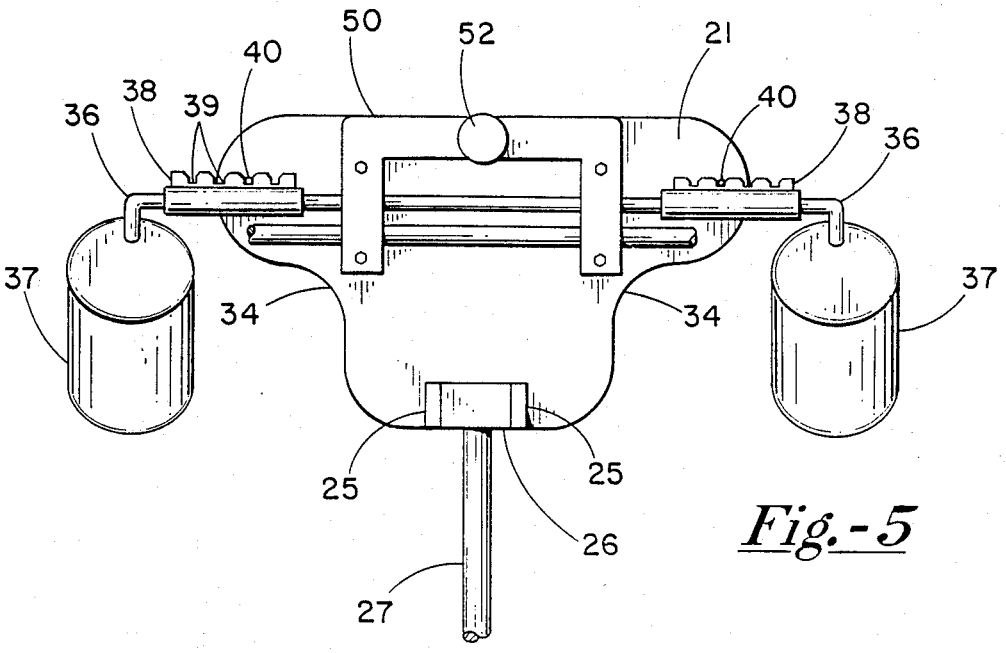

FIG. 4. is an enlarged fragmentary plan view to show details of the telescopic connection between the mast and the outboard end of the platform of the buttocks support of FIGS. 1–3; and FIG. 5 is an enlarged fragmentary end view of the buttocks support of FIGS. 1–3 to show details of the support for the thigh cushions.

As shown FIGS. 1–3 of the drawing, an operating table 10 has a kneeling attachment 12 permitting to kneel on a platform 14 with the torso positioned over one end of the operating table and the buttocks resting against a buttocks support 15. As taught in the Ray et al. patent, the platform can either be supported from the floor by a V-shaped leg 16 as shown in FIG. 1 or can be locked to move up and down with the operating table while the leg 16 is retracted as in FIG. 2.

The buttocks support 15 includes a metal U-shaped yoke 17 having two arms 18 and a crosspiece 20. Pivotably mounted on the crosspiece is a rigid seatplate 21, on the face of which is a buttocks cushion 22. The arms 18 of the yoke telescope at a friction lock 23 and are pivotably attached at 24 to the inboard end of the platform.

Mounted between two plates 25 bolted to the back of the seatplate 21 is a block 26 that is fixed to the upper end of a metal mast 27, the lower end of which is telescopically connected to the outboard end of the platform 14 by a ratchet assembly 28. As best seen in FIG. 4, the lower end of the mast 27 is slidably received by a bracket 29 that is fixed to the platform. Formed in the inner facing surface of the mast 27 are notches 30 into which fit a spring-loaded lever 32 (spring not shown). The lever is manually pivoted at 33 to be lifted from the notches, thus permitting the mast to be lowered, either until the lever 32 fits into another of the notches 30 or until the seatplate 21 reaches the retracted position shown in FIG. 3. In the retracted position, the seatplate becomes substantially horizontal, and the mast 27 extends along the bottom of the platform 14, thus virtually disappearing from view. Each side of the seatplate 21 and buttocks cushion 22 is cut away at 34 to permit it to clear a kneeling patient's feet 35 (FIG. 3). Because the buttocks cushion 22 faces upwardly in the retracted position, there is little danger that a patient's lower legs will be scuffed by any metal of the retracted buttocks support when the patient mounts or dismounts.

Pivotably and slidably positionable at the back of the seatplate 21 is each of a pair of metal L-shaped rods 36 as seen in FIG. 5. A first arm of each of the rods fits snugly into an off-center bore of a cylindrical thigh-supporting cushion 37. Welded to the second arm of each of the rods is a bracket 38 which is formed with notched 39 into which attendant lifts a thigh-supporting cushion 37, the bracket 38 is moved away from the pin, thus permitting the attendant to slide the second arm of the L-shaped rod 36 in the direction of the crosspiece 20 until its thigh-supporting cushion fits snugly against a patient's thigh, and then to push the cushion downwardly until the pin 40 fits into another notch 39. The off-center bores of the thigh-supporting cushions provide a fine adjustment of the snugness of the fit against the patient's thighs.

Before removing the kneeling attachmetn 12 and buttocks support 15 from the operating table, the L-shaped rods 36 and thigh-supporting cushions 37 are removed, and the yoke 17 is retracted to the position of FIG. 3. The V-shaped leg 16 also is retracted and held in place by a Velcro strap 41. The kneeling attachment and buttocks support can then be detached from the operating table as a neat package that is easy to stow.

As shown in FIG. 2, a framework 42 can be mounted on the buttocks support 15. The framework has a substantially rectangular rigid frame 44 provided by a metal rod that forms a complete rectangle having two long parallel legs 46, the ends of which are interconnected by crossarms (not shown). At the center of the outboard crossarm is a hinge 47 having a tang that fits into a slot 48 between the back of the seatplate 21 and a split bracket 50 that is bolted to the seatplate. When the tang of the hinge 47 is inserted into the slot 48 as shown in FIG. 2, a knob 52 that is threaded into under half of the split bracket is tightened into a seat (not shown) in the hinged plate to lock the outboard crossarm of the frame 44 to the buttocks support 15.

The framework 42 should be mounted on the buttocks support 15 after the latter and the patient have been covered by surgical drapery. This enables the framework to be removed and reattached without disturbing thge drapery. After the the drapery has been pushed into the slot 48 by the tang of the hinge 47, it would be awkward to tighten the knob 52 through the drapery. Hence, it would be preferred to employ some other means for clamping the tang of the hinge into the slot 48. For example, the tang could be clamped by a toggle actuated by moving a lever that is inside the drapery but can be pushed from the outside of the drapery. Another means would employ a hinge having split tang which is expandable by turing a screw that is outside of the drapery.

Welded to the inboard end of each of the legs 46 of the rigid frame 44 is a stub 53 which receives a threaded collar 54 at the end of a shaft 53, the other end of which is attached by a split clamp 56 to one of the arms 18 of the U-shaped yoke 17. After doing so, retractors and other surgical instruments can be removably mounted on the frame 44 and thus accurately positioned at a surgical wound in a patient's back. Any force applied laterally to a retractor mounted on the frame 44 is counterbalanced by the thigh-supporting cushion 37 at the opposite side of the buttocks support 15, so that the patient is not moved out of position by the applied force.

We claim:

1. Buttocks support useful in conjunction with a kneeling attachment including a platform on which a patient kneels with the torso positioned over one end of an operating table, said buttocks support comprising:

a rigid seatplate, elongated support means for connecting the seatplate to the inboard end of the platform, a mast, means for connecting one end of the mast to the seatplate at a point beneath said elongated support means in order to support the seatplate against downward force, and pivotable means for telescopically connecting the other end of the mast to the outboard end of the platform to permit the seatplate to be lowered to the level of the platform and to be adjustably raised to support the patient's buttocks while the platform is connected to the operating table.

2. Buttocks support as defined in claim 1 wherein said elongated support means for connecting the seatplate comprises a U-shaped yoke, the arms of which are telescoping.

3. Buttocks support as defined in claim 1 and further comprising a cushion mounted on the seatplate.

4. Buttocks support as defined in claim 3. and further comprising thigh-supporting cushion means retractably mounted on the seatplate.

5. Buttocks support as defined in claim 4 wherein the thigh-supporting cushion means include a pair of L-shaped rods, one arm of each being pivotably attached to the seatplate and the other adapted to receive a thigh-supporting cushion.

6. Buttocks support as defined in claim 3 wherein the rigid seatplate is cut away to clear the feet of a kneeling patient when the buttocks support is lowered to the level of the platform.

7. Buttocks suppoort as defined in claim 1 including means for releasably attaching to the buttocks support a rigid frame for supporting surgical instruments above a kneeling patient's back.

8. Buttocks support as defined in claim 7 wherein said rigid frame is substantially rectangular.

9. Kneeling attachment to an operating table, which attachment comprises:

a radiotransparent platform on which a patient kneels with the torso positioned over one end of an operating table, a rigid seatplate, elongated support means for connecting the seatplate to the inboard end of the platform, a mast, means for connecting one end of the mast to the seatplate at a point beneath said elongated support means to support the seatplate against downward force, and pivotable means for telescopically connecting the end of the mast to the outboard end of the platform to permit the seatplate to be lowered to the level of the platform and to be adjustably raised to support the patient's buttocks while the platform is connected to the operating table.

10. Kneeling attachment as defined in claim 9, wherein said elongated support means comprises a U-shaped yoke.

11. Kneeling attachment as defined in claim 10 wherein the arms of the U-shaped yoke are telescoping.

12. Kneeling attachment as defined in claim 9 and further including means for releasably attaching to the buttocks support a rigid frame for supporting surgical instruments above a kneeling patient's back.

13. Kneeling attachment to an operating table, which attachment includes a radiotransparent platform on which a patient kneels with the torso positioned over one end of an operating table, a buttocks support connected by elongated support means to the platform, said buttocks support including a rigid seatplate, means projecting from the seatplate for retractably holding a pair of thigh cushions for lateral support of the thighs of a kneeling patient, a buttocks cushion mounted on the seatplate, a mast, one end of which is mounted on the seatplate at a point beneath said elongated support means in order to support the seatplate against downward force, and pivotable means for telescopically connecting the other end of the mast to the platform to permit the buttocks support to be lowered to the level of the platform and to be adjustably raised to support the patient's buttocks while the platform is connected to the operating table.

14. Kneeling attachment as defined in claim 13 wherein said buttocks support and elongated support means further comprise a rigid U-shaped yoke, the arms of which are telescopically connected to the inboard end of the platform.

15. Kneeling attachment as defined in claim 14. and further including means for releasably attaching to the buttocks support a rigid, substantially rectangular frame that borders the trunk of a kneeling patient and can support surgical instruments above a kneeling patient's back.

* * * * *

UNITED STATES PATENT AND TRADEMARK OFFICE

CERTIFICATE OF CORRECTION

PATENT NO. : 4,824,089

DATED : April 25, 1989

INVENTOR(S) : Eugene A. Dickhudt and Charles D. Ray

It is certified that error appears in the above-identified patent and that said Letters Patent is hereby corrected as shown below:

In col. 1, line 64, "alo." after "patent" to --al.--
In col. 1, line 65, change "platofrm" to --platform--
In col. 2, line 7, there should be a paragraph following "crosspiece, and"
In col. 2, line 32, --and-- should be inserted after "yoke"
In col. 2, line 33, delete --means--
In col. 2, line 38, "seatplace" should be --seatplate--
In col. 2, line 40, "in the seatplate" should be --to the seatplate--
In col. 3, line 6, change "back sugery" to --back surgery--
In col. 3, line 17, insert --a patient-- after "permitting"
In col. 3, line 31, insert --14-- after "platform"
In col. 3, line 53, insert "part" after --metal--
In col. 3, line 60, change "notched" to --notches--
In col. 3, line 61, after "into which" insert --fits a pin 40 protruding from the back of the seatplate 21. When an--
In col. 4, line 3, change "attachmetn" to --attachment--
In col. 4, line 22, insert --50-- after "bracket"
In col. 4, line 29, before "drapery" change "thge" to --the
In col. 4, line 37, after "having" insert --a--
In col. 4, line 38, after "by" change "turing" to --turning
In col. 4, line 42, after "shaft" change "53" to --55--

Signed and Sealed this

Second Day of January, 1990

*Attest:*

JEFFREY M. SAMUELS

*Attesting Officer* *Acting Commissioner of Patents and Trademarks*